United States Patent [19]

Golden

[11] Patent Number: 4,457,208

[45] Date of Patent: Jul. 3, 1984

[54] DRUM-TYPE AMMUNITION MAGAZINE

[75] Inventor: Michael D. Golden, Costa Mesa, Calif.

[73] Assignee: Western Design Corporation, Irvine, Calif.

[21] Appl. No.: 385,506

[22] Filed: Jun. 7, 1982

[51] Int. Cl.[3] ..... F41D 10/26

[52] U.S. Cl. ..... 89/33.02; 89/33.04

[58] Field of Search ..... 89/335 F, 33 D, 34, 89/46

[56] References Cited

U.S. PATENT DOCUMENTS

| | | | |
|---|---|---|---|
| 290,622 | 12/1883 | Accles | 89/33 D |
| 1,256,924 | 2/1918 | Nelson | 89/33 D |
| 1,303,028 | 5/1919 | Cashmore | 89/33 D |
| 1,329,979 | 2/1920 | Lang | 89/33 D |
| 1,330,873 | 2/1920 | Hulse | 89/33 D |
| 1,335,677 | 3/1920 | Fox et al. | 89/33 D |
| 1,337,893 | 4/1920 | Farquhar et al. | 89/33 D |
| 1,394,494 | 10/1921 | Green | 89/33 D |
| 1,846,034 | 2/1932 | Larsson et al. | 89/33 D |
| 2,407,461 | 9/1946 | Vesely | 89/33 D |
| 2,833,182 | 5/1958 | Houston et al. | 89/33 D |
| 2,935,914 | 5/1960 | Darsie et al. | 89/33 D |
| 3,498,178 | 3/1970 | Meyer et al. | 89/33 D |

FOREIGN PATENT DOCUMENTS

| | | | |
|---|---|---|---|
| 1523432 | 8/1978 | United Kingdom | 89/46 |

*Primary Examiner*—Stephen C. Bentley

*Attorney, Agent, or Firm*—Fowler, Lambert & Hackler

[57] ABSTRACT

A drum-type ammunition magazine includes a plurality of concentric ammunition bays therein with each bay having disposed therein a plurality of fixed tiered partitions for supporting linkless ammunition and a rotatably mounted ammunition carrier for moving the linkless ammunition within the bays and between the fixed tiered partitions and toward a port communicating with each ammunition bay. The ammunition carriers may be operated independent of each other, enabling storage of a different type of ammunition in each of the ammunition bays.

13 Claims, 5 Drawing Figures

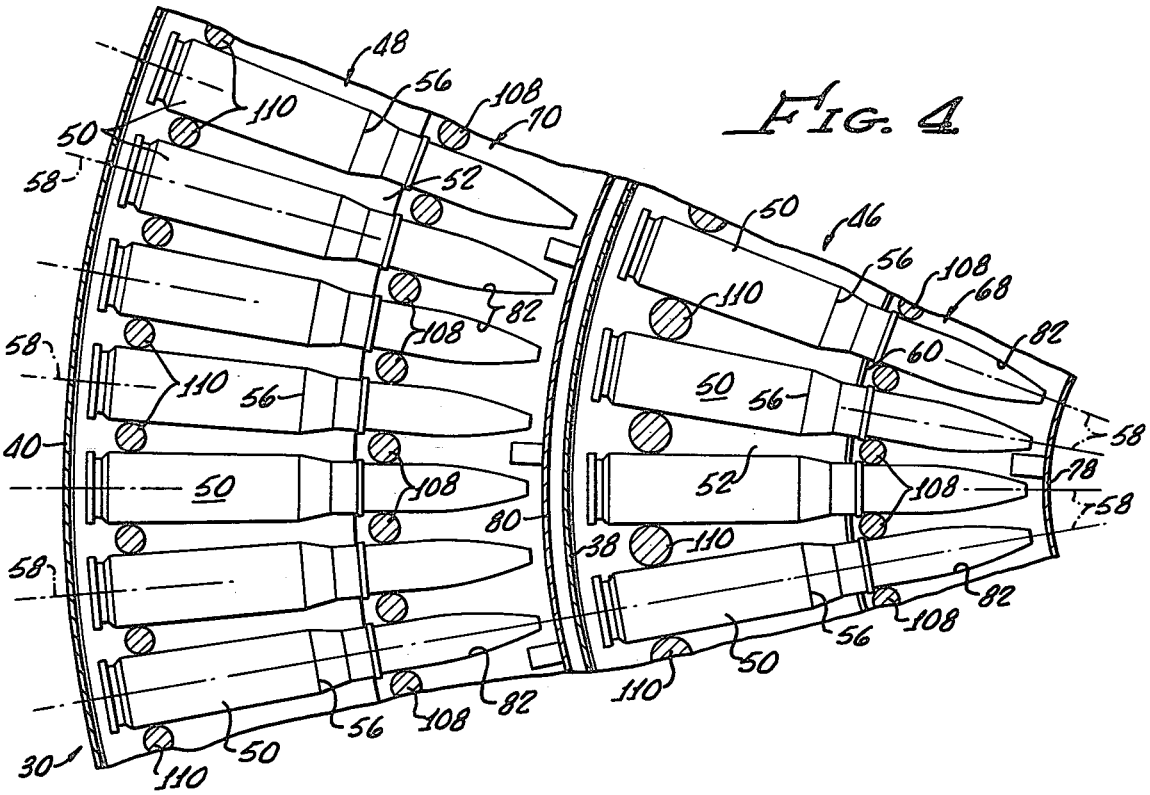
FIG. 4
FIG. 5.
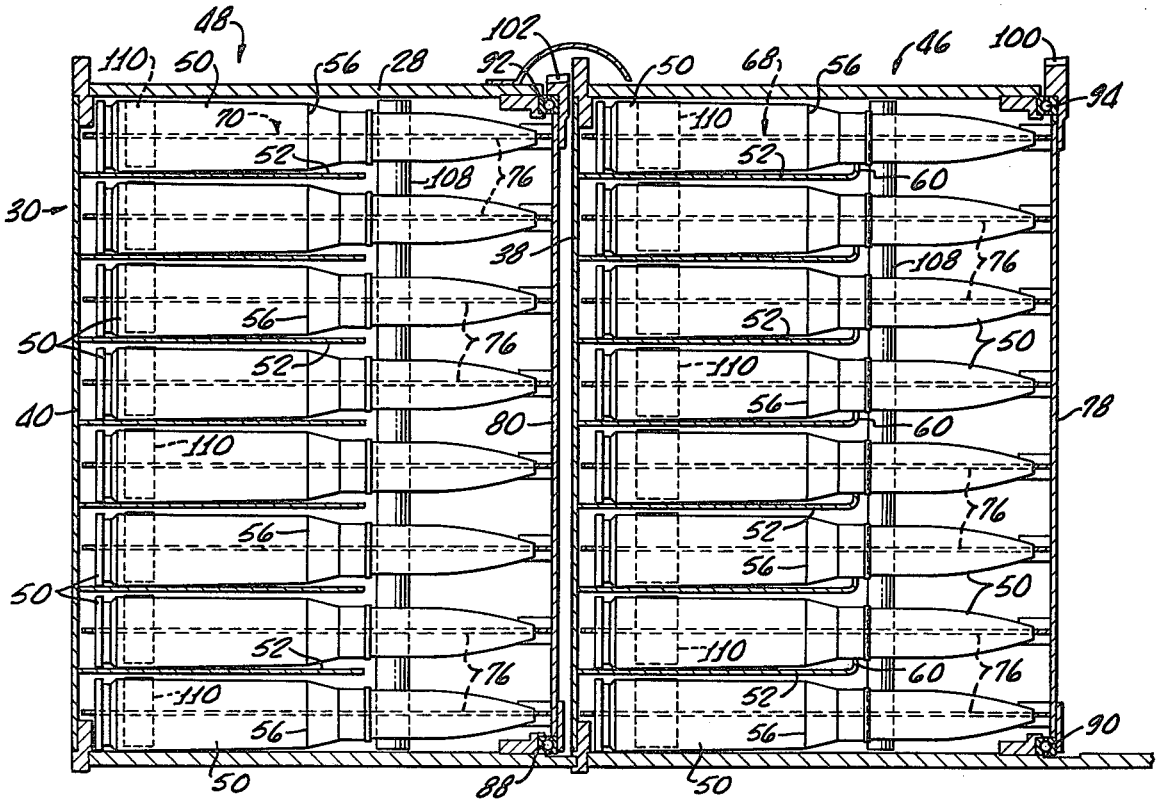

DRUM-TYPE AMMUNITION MAGAZINE

BACKGROUND

The present invention relates generally to ammunition storage and more particularly to a volumetrically efficient drum-type ammunition magazine amenable for installation on transport vehicles having a turret type gun.

It is to be appreciated that although the present invention has particular advantage for use in limited space and weight environments, such as aboard transport vehicles, ships and the like, the general principles taught by the invention may have use in other ammunition handling systems.

As to limited space/weight applications, it is desirable that an ammunition magazine be volumetrically efficient, that is, hold a large number of rounds per unit volume. A linkless feed system is desirable in this regard, because linked ammunition necessarily includes the "dead" weight associated with the links which support and help guide the individual ammunition rounds.

In addition, the rate of fire of modern guns may be hundreds or thousands of rounds per minute. This results in very high acceleration and deceleration in the ammunition supply system which make belts formed by cartridge carrying links unsatisfactory because of breakage or separation which may occur.

Further, modern larger caliber guns, such as 25mm, are capable of firing a variety of ammunition types such as high explosive, armour piercing, among others; hence, an ammunition magazine compatable with the weapon for utilizing this feature to its greatest advantage should be able to store more than one type of ammunition and be capable of feeding each type of ammunition to the weapon upon demand without significant interruption of the weapon firing rate.

It is also important that the ammunition magazine be structurally compatable with the turret mounted weapon so that the magazine does not interfere with the range of motion of the turret or otherwise limit the firing envelope of the weapon. In many cases this requires the ammunition magazine to be installed in a remote position from the gun.

Numerous other ammunition magazines that have a general DRUM-TYPE configuration have been invented in the past, and at least three types are known to be in current use. However, none are known that have the ability to independently feed two of more different types of ammunition.

One known type consists of a fixed continuous helical outer partition to guide and support the ammunition case, and a rotating "stave" inner drive means to drive the ammunition rounds, by interface with the projectile and shoulder position of the round, around the fixed helical outer portion. It is easily appreciated that such a continuous outer helical guide is both difficult and expensive to manufacture. Also, because the outer helical guide must be continuous, the inner stave guide means must stop well short of extending radially outward to the base of the round, which results in unfavorable efficiencies and subsequent higher loads and power requirements.

A second type consists of a rotating helical inner drive means (looking very much like a post-hole digging auger) which propells ammunition rounds axially, with the ammunition rounds being restrained and guided by fixed longitudinal tracks in the stationary outer drum. The apparent advantage of this type is that the multiple rows all progress very slowly toward the exit end of the drum. As the ammunition rounds move slowly, the inertia of the ammunition rounds is small which promotes the ability of the system to start very rapidly. Unfortunately, the speed and mass of the rotating center helix is quite large, which detracts from the apparent advantage obtained from low ammunition round velocity, and transmission of drive power to the ammunition round is poor due to high sliding velocities between the rotating center helix and the ammunition rounds. Further, the system is complicated because the ammunition rounds exits the drum at all radial positions, which requires an additional "Scoop Disc Assembly", or the like, to obtain a continuous single stream output at a fixed location. See U.S. Pat. No. 2,935,914, issued to B. Darsie ET AL.

A third type, which is in fact a variant of the second type, utilizes a fixed inner helix with a rotatable outer drum and longitudinal track assembly. This design eliminates the need of a Scoop Disc Assembly, but results in high round inertia.

The present invention provides a lightweight volumetric efficient ammunition magazine capable of storing a plurality of different types of ammunition within a single magazine and separately delivering such different types of ammunition upon demand without the need for expensive helical guides or drive means.

SUMMARY OF THE INVENTION

In accordance with the present invention an ammunition magazine includes a drum-type housing, means defining a plurality of bays concentrically disposed within the drum-type housing and means for supporting ammunition rounds within each of the concentrically disposed bays along directions defined by radii of the drum-type housing.

Further, ammunition carrier means, rotatably mounted within each concentrically disposed bay are provided for moving said ammunition rounds within the concentrically disposed bays and means are provided for rotating the ammunition carrier means within the concentrically disposed bays.

More particularly, a magazine is provided for the storage and dispensing of linkless ammunition in which the drum-type housing has a top and a bottom therein and means defining a plurality of ports in the top for passage of linkless ammunition rounds therethrough. The means defining a plurality of concentric bays defines both an inner bay and an outer bay and the means for supporting the ammunition includes a plurality of fixed tiered partitions for supporting linkless ammunition rounds therein along directions defined by radii of the drum-type housing.

Means are provided for separately rotating the ammunition carrier means within the inner and outer bays, and ramp means, interconnected between adjacent fixed tiered partitions, are provided for transferring linkless ammunition rounds from one fixed tiered partition to another and thereafter to the corresponding port as each ammunition carrier means is rotated.

Tab means disposed on said ammunition carrier means and between each linkless ammunition round drive the linkless ammunition rounds along the ramp means from one fixed tiered partition to another as the ammunition carrier is rotated.

Because the concentric bays are separately disposed in the drum-type housing and the ammunition carrier means may be operated separately from one another within each of the concentric bays, a different type of ammunition may be stored in each of the bays and separately withdrawn therefrom upon demand.

As a further advantage of the present invention, the carrier means is highly efficient in moving the ammunition rounds within the magazine because it drives the ammunition rounds over their entire length and thereby enables the ammunition rounds to roll, rather than slide, which reduces frictional loading.

BRIEF DESCRIPTION OF THE DRAWINGS

The advantages and features of the present invention will appear from the following description when considered in conjunction with the accompanying drawings, in which;

FIG. 4 is a partial top view of the ammunition carrier showing the disposition of the ammunition rounds along directions defined by radii of the drum-type housing and between tabs disposed on the ammunition carriers for driving the ammunition rounds along the ramps (FIG. 3) from one tiered partition to another; &

FIG. 5 is a partial cross-section of the inner and outer bay more clearly showing the relationship between the fixed tiered partitions and the ammunition carriers.

DETAILED DESCRIPTION

Figure 1:
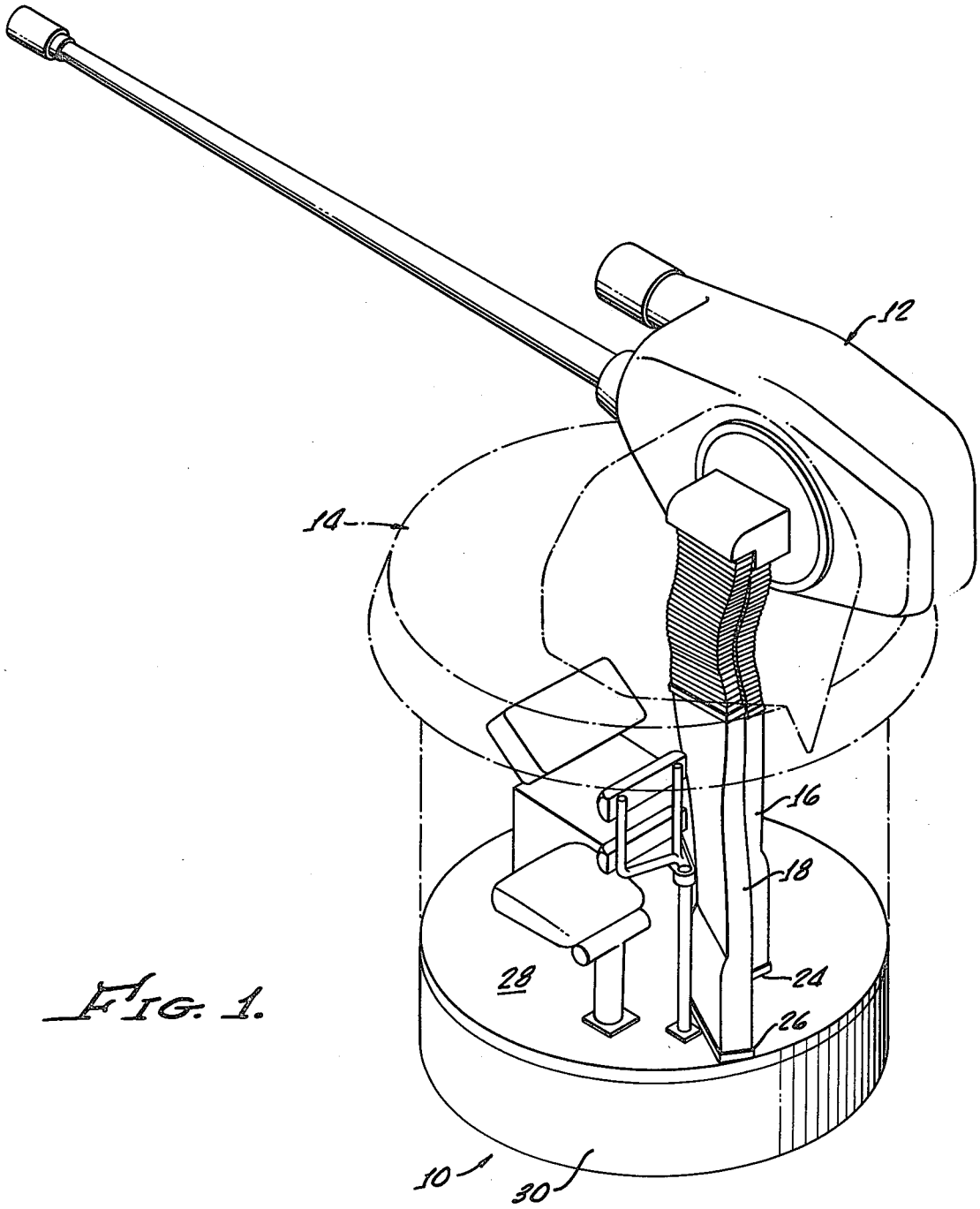
FIG. 1 is a perspective view of the ammunition magazine according to the present invention in an operative relationship with a turret mounted automatic rapid fire gun as it may be employed on a transport vehicle and showing the ammunition magazine being disposed directly under the turret.

Turning now to FIG. 1 there is shown in perspective view, an ammunition magazine 10 in accordance with the present invention showing the magazine 10 in an operative relationship with a gun 12 mounted on a turret 14, all of which may be disposed on a transport vehicle (not shown).

The magazine 10 communicates with the gun 12 via a pair of feed chutes 16, 18, extending from ports 24, 26, disposed in a top portion 28 of the drum-type housing 30. It should be appreciated that the feed chutes 16, 18, as well as the gun 12 and the turret 14, are not part of the present invention but are shown as a typical installation of the ammunition magazine 10.

Figure 2:
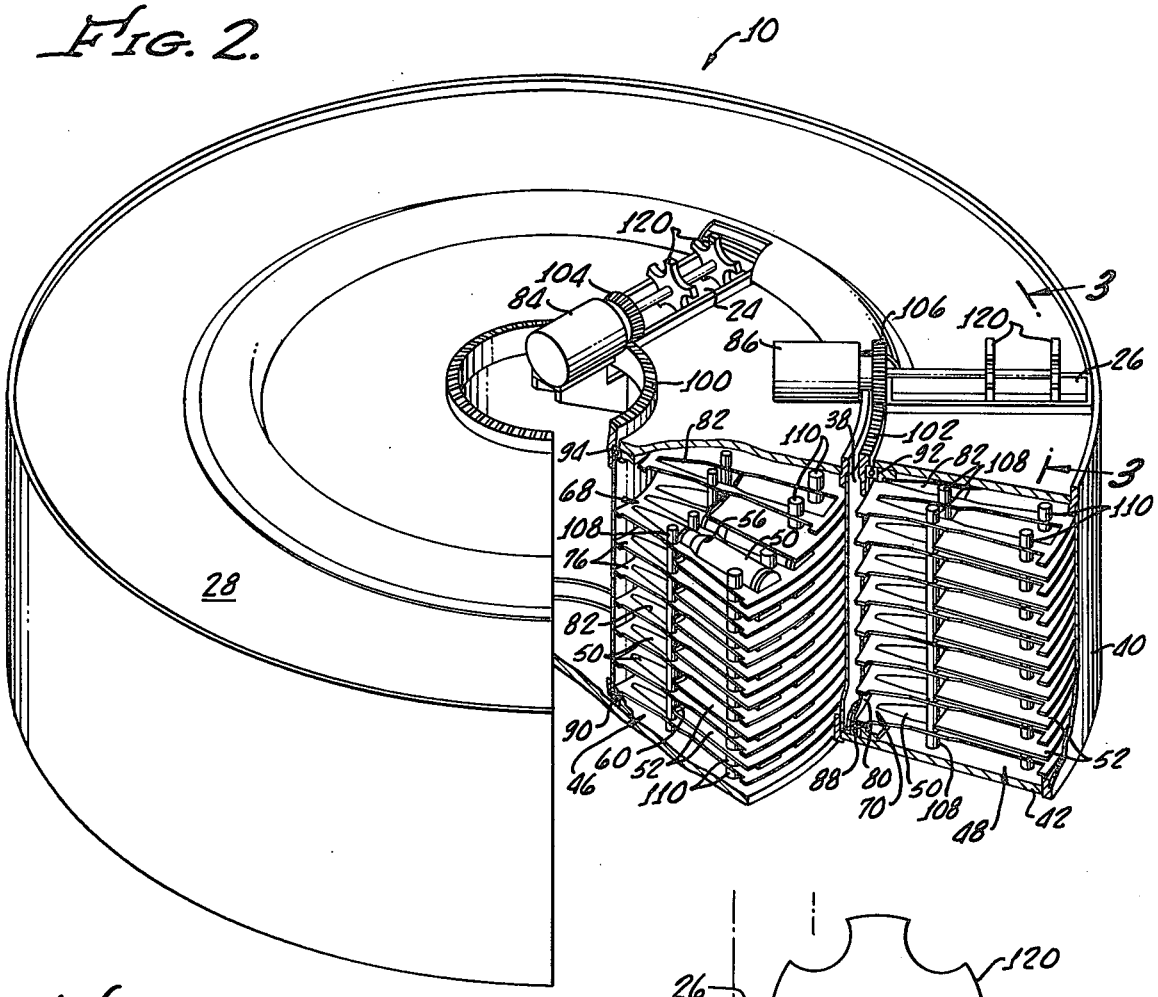
FIG. 2 is a perspective view of the drum-type housing of ammunition magazine partially broken away to show ammunition rounds disposed therein supported by a plurality of fixed tiered partitions disposed in concentrically disposed inner and outer bays and an ammunition carrier rotatably mounted within each of the inner and outer bays for separately moving the ammunition rounds within the inner and outer bays, respectively, as well as means for rotating the ammunition carriers within the concentrically disposed inner and outer bays.

An enlarged perspective view of the magazine 10, partially broken away, is shown in FIG. 2. In general, a center and an outside wall 38, 40, respectively, as well as the top 28 and a bottom 42 provides means defining an inner and an outer bay 46, 48, respectively, within the drum-type housing 30.

It should be appreciated that for illustrative purposes only two bays, an inner and an outer, are shown; however, depending on the requirements of the magazine 10, in accordance with the present invention, a greater number of bays may be employed.

In addition, in as much as the inner bay 46 and the outer bay 48 are similar except for size, the outer bay will be primarily described with all such description and comment applying to the inner bay except for specific differences as may be pointed out.

The illustrated configuration for the magazine of the present invention is for 25 mm caliber ammunition rounds 50 provides for the storage of 576 rounds of ammunition in the outer bay 48 which may be primary or high explosive ammunition, and 288 rounds of ammunition in the inner bay 46 which may be secondary or armour piercing ammunition. The outer bay 48 may have an outer radius of about 25 inches and the inner bay 46 may have an outer radius of about 14 inches with the height of the magazine being about 14 inches.

Figure 3:
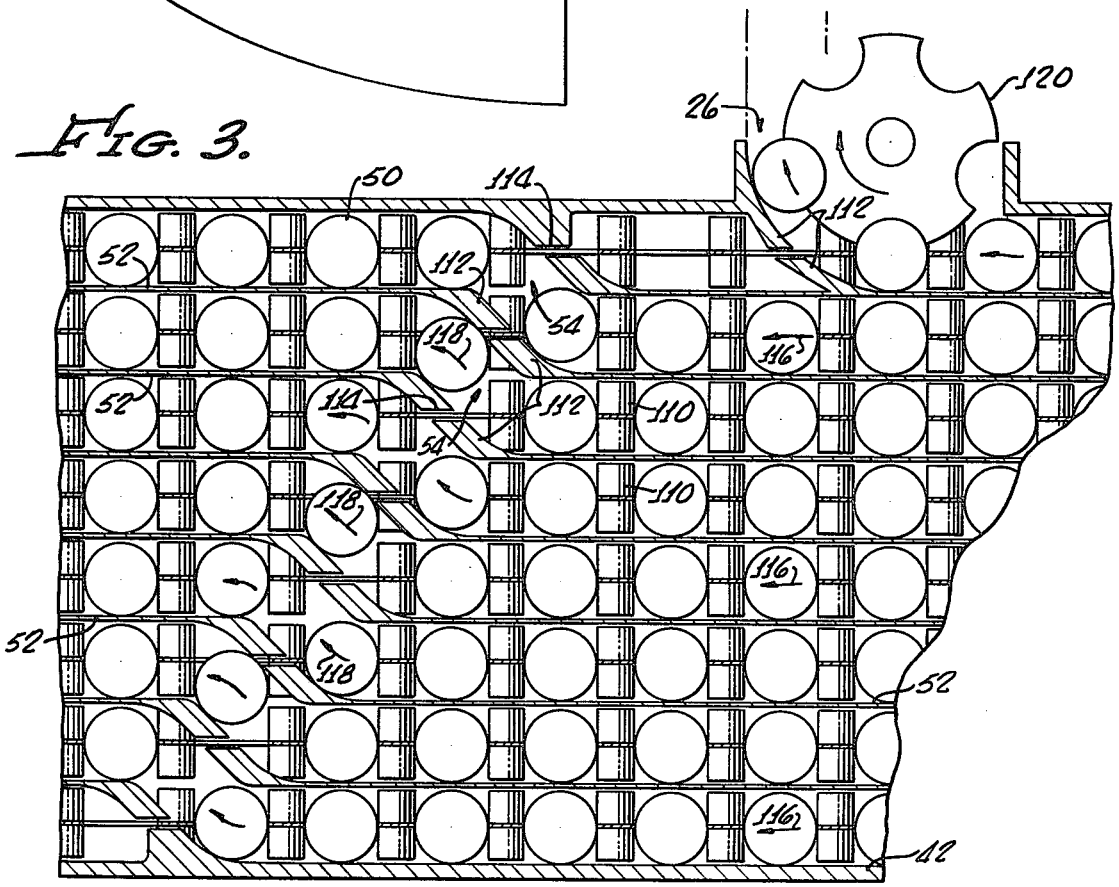
FIG. 3 is a partial cross-section taken along the line 3—3 in FIG. 2 showing in greater detail the fixed tiered partitions for supporting the ammunition rounds as well as ramps interconnected between adjacent fixed tiered partitions for transporting the ammunition rounds from one adjacent fixed tiered partition to another as the ammunition carrier is rotated.

Seven fixed tiered circular partitions 52 are attached to the outer wall 40 for supporting the ammunition rounds 50, and as shown in FIG. 3, each of the fixed partitions 52 have a gap 54 therein to enable the ammunition rounds to transition from one fixed tiered partition to another as will be described hereinafter in greater detail. The fixed partitions 52 extend inwardly toward the center of the magazine to an extent necessary to support the approximately right cylindrical portion 56 of the ammunition round 50 (see FIG. 4).

The fixed partitions 52 are spaced apart a distance greater than the maximum diameter of the ammunition round 50 and support the rounds along direction defined by radii 58 of the drum-type housing.

As best shown in FIG. 5 the inner bay 46, the partitions 52 may have an upturned portion 60 for supporting the round 50. This latter feature promotes low friction rolling of the round 50 on the fixed partition 52 as the rounds are moved within the bays 46, 48.

Ammunition carriers 68, 70 concentrically and rotatably mounted within the inner and outer bays 46, 48, respectively provide means for moving the ammunition rounds 50 within the inner and outer bays, respectively, and between the fixed partitions 52.

Each ammunition carrier 68, 70 consists of eight carrier rings 76, attached to movable upright partitions 78, 80, respectively, having a series of cutouts 82 conforming to contour of an ammunition rounds 50. The ammunition rounds 50 ride, or roll, on the fixed partitions 52 within the confines of the cutouts 82 as the ammunition carrier is rotated by motors 84, 86, respectively.

Bearings 88, 90 support the movable partitions 78, 80 at the bottom 40 of the magazine and bearings 92, 94 support the movable partitions 78, 80 at the top 28 for rotation within the outer and inner bays 48, 46 respectively.

Attached to each of the movable partitions 78, 80 are ring gears 100, 102 disposed for engagement with drive gears 104, 106 attached to the motor 84, 86 respectively.

As will be hereinafter discussed in connection with the operation of the magazine 10, the carrier rings have inner and outer transfer tabs, 108, 110 attached thereto for guiding or driving the ammunition rounds 50 during transition of the rounds from one fixed partition to an adjacent fixed partition.

Structurally, the transfer tabs 108, 110 add strength to the carrier rings 76 and help support the carrier rings in a spaced-apart relationship. As best shown in FIG. 2, the inner transfer tabs 108 are connected together between the carrier rings where as the outer tabs 110 are shorter and do not connect as they have a small running clearance with the fixed partitions 52.

FIG. 3 shows in detail ramps 112 extending between adjacent fixed partitions 52 which provide a means for transferring, or transitioning ammunition rounds from one fixed tiered position to another and thereafter to the correspondent port 24, 26, as each ammunition carrier 68, 70 is rotated by the motors 84, 86. As shown in FIG. 3 a slot 114 is provided in each ramp 112 in order to enable the carrier rings 76 to pass therethrough.

It should be appreciated that the magazine 10 construction is amenable to modular construction, and although not shown in the FIGURES, it is apparent that the carriers 76 and the center and outer walls 38, 40 may be readily designed as "bolt-together" layers which enables the rapid assembly of a magazine 10 of any desired capacity by assembling together as many layers as needed.

In operation, the drive motors 84, 86 rotate the ammunition carriers via the drive gears 102, 104 and the ring gears 98, 100. As the ammunition carrier 84, 86 are moved in a direction shown by arrows 116 in FIG. 3 between the fixed partitions 52 they are driven upwardly from lower fixed partitions to higher fixed partitions along the ramps 112 by the transfer tabs 110 along the directions indicated by the arrow 118 until they reach the exit port 26 where they are taken from the part by handoff apparatus 120, the latter not being part of the present invention.

The reloading of the magazine 10 can is rapidly achieved by running the motors in reverse and feeding ammunition to the handoff apparatus 120.

Although there has been described hereinabove a particular arrangement of an ammunition magazine in accordance with the present invention for the purpose of illustrating the manner in which the invention may be used to advantage, it should be appreciated that the invention is not limited thereto. Accordingly, any and all modifications variations or equivalent arrangements which may occur to those skilled in the art, should be considered to be within the scope of the invention as defined in the appended claims.

What is claimed is:

1. An ammunition magazine comprising:

a drum-type housing;

means defining a plurality of bays concentrically disposed within the drum-type housing;

means including a plurality of fixed tiered partitions disposed in each of the concentrically disposed bays for supporting ammunition rounds therein;

ammunition carrier means rotatably mounted within each concentrically disposed bay for moving said ammunition rounds within said concentrically disposed bays and between said tiered partitions; and, means for rotating said ammunition carrier means within the concentrically disposed bays.

2. An ammunition magazine comprising:

a drum-type housing;

means defining an inner and an outer bay concentrically disposed within the drum-type housing;

means including a plurality of fixed tiered partitions disposed in the inner and the outer bays for supporting ammunition rounds therein;

ammunition carrier means rotatably mounted within the inner and the outer bay for moving said ammunition rounds within the inner and outer bays, respectively, and between said tiered partitions; and, means for rotating said ammunition carrier means within the inner and outer bays.

3. An ammunition magazine comprising:

a drum-type housing;

means defining a plurality of bays concentrically disposed within the drum-type housing;

means including a plurality of fixed tiered partitions disposed in each of the concentrically disposed bays for supporting linkless ammunition rounds therein;

ammunition carrier means rotatably mounted within each concentrically disposed bay for moving said linkless ammunition rounds within said concentrically disposed bays and between said tiered partitions; and, means for rotating said ammunition carrier means within the concentrically disposed bays.

4. The ammunition magazine of claims 1, 2 or 3 wherein the means for rotating said ammunition carriers is operative for rotating each ammunition carrier means separately.

5. The ammunition magazine of claims 1, 2 or 3 wherein the plurality of fixed tiered partitions are disposed for supporting the ammunition rounds along directions defined by radii of the drum-type housing.

6. The ammunition magazine of claims 1, 2 or 3 wherein the ammunition carrier means is configured for rolling said ammunition rounds between said tiered partitions.

7. An ammunition magazine comprising;

a drum-type housing having a top and a bottom and means defining a plurality of ports in the top for passage of ammunition rounds therethrough;

means defining a plurality of bays concentrically disposed within the drum-type housing, each said bay communicating with a corresponding port;

means including a plurality of fixed tiered partitions disposed in each of the concentrically bays for supporting ammunition rounds therein;

ammunition carrier means rotatably mounted within each concentrically disposed bay for moving said ammunition rounds within said concentrically disposed bay and between said fixed tiered partitions;

means for rotating said ammunition carrier means within the concentrically disposed bays; and, means for transferring said ammunition rounds from one fixed tiered partitions to another and thereafter to the corresponding port as each ammunition carrier means is rotated.

8. A magazine for storage and dispensing of linkless ammunition comprising:

a drum-type housing having a top and a bottom and means defining a plurality of ports in the top for passage of linkless ammunition rounds therethrough;

means defining a plurality of bays concentrically disposed within the drum-type housing, each said bay communicating with a corresponding port;

means including a plurality of fixed tiered partitions disposed in each of the concentrically disposed bays for supporting linkless ammunition rounds therein;

ammunition carrier means rotatably mounted within each concentrically diposed bay for moving said linkless ammunition rounds within concentrically disposed bays and between said fixed tiered partitions;

means for rotating said ammunition carrier means within the concentrically disposed bays; and, means for transferring said linkless ammunition rounds from one fixed tiered partition to another and thereafter to the corresponding port as each ammunition carrier means is rotated.

9. The ammunition magazine of claim 8 wherein the means for rotating said ammunition carrier is operative for rotating each ammunition carrier means separately.

10. The ammunition magazine of claim 9 wherein the plurality of tiered fixed partitions are disposed for supporting the linkless ammunition rounds along directions defined by radii of the drum-type housing.

11. The ammunition magazine of claim 10 wherein the means for transferring said linkless ammunition rounds from one fixed tiered partition to another includes ramps interconnected between adjacent fixed tiered partitions.

12. The ammunition magazine of claim 11 further comprising tab means disposed on said ammunition carriers and between each linkless ammunition rounds for driving the linkless ammunition rounds along said ramps from one fixed tiered partition to another.

13. A magazine for storage and dispensing of linkless ammunition comprising;

a drum-type housing having a top and a bottom and means defining a plurality of parts in the top for passage of linkless ammunition rounds therethrough;

means defining an inner and an outer bay concentrically disposed within the drum-type housing;

means including a plurality of fixed tiered partitions disposed within the inner and the outer bays for supporting linkless ammunition rounds therein along directions defined by radii of the drum-type housing;

ammunition carrier means concentrically and rotatably mounted within the inner and the outer bay for moving said ammunition said linkless ammunition rounds within the inner and the outer bays, respectively, said ammunition carrier means being configured for rolling said ammunition rounds between said tiered partitions;

means for separately rotating the ammunition carrier means within the inner and the outer bay;

ramp means interconnected between adjacent fixed tiered partitions for transferring linkless ammunition rounds from one fixed tiered partition to another and thereafter to the corresponding port as each ammunition carrier means is rotated;

tab means disposed on said ammunition carriers means and between each linkless ammunition rounds for driving the linkless ammunition rounds along said ramp means from one fixed tiered partition to another.

* * * * *